United States Patent [19]

Chisum

[11] 4,378,035

[45] Mar. 29, 1983

[54] MACHINE TO PREPARE LOGS FOR LOG HOUSES

[76] Inventor: Finis L. Chisum, Box 1145, Claremore, Okla. 74017

[21] Appl. No.: 201,045

[22] Filed: Oct. 27, 1980

Related U.S. Application Data

[63] Continuation of Ser. No. 925,213, Jul. 17, 1978, abandoned.

[51] Int. Cl.[3] ..... B27C 1/08

[52] U.S. Cl. ..... 144/1 R; 144/3 R; 144/4; 144/367; 83/473

[58] Field of Search ..... 118/35, 316, 326; 83/425, 473; 144/1 R, 2 R, 3 R, 3 A, 3 B, 309 R, 312, 323, 324, 326 R, 367, 4

[56] References Cited

U.S. PATENT DOCUMENTS

| | | | |
|---|---|---|---|
| 2,902,069 | 9/1959 | Gentry, Jr. | 144/3 R |
| 3,791,430 | 2/1974 | Hood et al. | 144/3 R |
| 3,848,647 | 11/1974 | Fell | 144/1 R |

*Primary Examiner*—W. D. Bray

*Attorney, Agent, or Firm*—Head, Johnson & Stevenson

[57] ABSTRACT

A machine for processing wood logs for construction of log houses. The machine includes means to load raw logs into a self-centering means, whereby a carriage assembly can be centered over the logs and the log is mounted in the carriage on powered centers, by means of which it can be rotated. The carriage travels longitudinally on tracks on a linear frame past a plurality of rotating cutters. As the log rotates the cutters cut the log down to a selected final diameter. The carriage is then run back to its starting point, the centers are locked so that the log cannot rotate and two cutters are positioned at equal distances above and below the axis of the log to cut tongues and grooves on the top and bottom of the log, respectively. Additional means are provided for cutting a saddle notch beneath the log, to cut the logs to precise length, to cut a vertical notch in each end for the purpose of joining logs end-to-end, and means for longitudinally slitting the log.

22 Claims, 32 Drawing Figures

MACHINE TO PREPARE LOGS FOR LOG HOUSES

This is a continuation of application Ser. No. 925,213, filed July 17, 1978 now abandoned.

CROSS-REFERENCE TO RELATED APPLICATION

This Application is related to U.S. Pat. No. 3,951,187 filed Apr. 24, 1975, as Ser. No. 571,373, and issued Apr. 20, 1976, entitled "MACHINE TO PREPARE LOGS FOR LOG HOUSES".

It is also related to U.S. Pat. No. 4,047,350, filed Apr. 19, 1976, as Ser. No. 678,238, and issued Sept. 13, 1977, as a continuation-in-part of Ser. No. 571,373, and entitled "LOG PRODUCT AND IMPROVEMENTS IN MACHINE TO PREPARE LOGS FOR LOG HOUSES".

It is also related to application Ser. No. 812,817, filed July 5, 1977, and now U.S. Pat. No. 168,675, as a Division of Copending application Ser. No. 678,238.

It is also related to Ser. No. 822,801, filed Aug. 8, 1977, and now U.S. Pat. No. 4,126,977 as a continuation-in-part of Ser. No. 678,238, entitled "CONTOUR OF LOG CABIN LOGS FOR MAXIMUM SEAL".

This application is a continuation-in-part of Ser. No. 812,817.

BACKGROUND OF THE INVENTION

This invention lies in the field of housing construction and preparation of lumber therefor. More particularly, it concerns the preparation of cylindrical logs of selected diameters and lengths, prepared so that they can be rapidly set up in the form of walls of a house or building.

In the days before the development of suitable saw mills for the preparation of board lumber for the construction of homes, logs were cut by hand to be more or less of a selected cylindrical size and were fitted together by means of saddle notches, etc. to provide an enclosure for the purpose of protection from the weather, etc.

The construction of a house in the form of a log cabin has notable advantages, particularly in the strength and rigidity of the structure and in the thermal insulation provided by the thick wood logs. However, because of the difficulty of providing truly cylindrical logs, properly fitted with tongues and grooves so as to seal against the weather, the construction of houses by the use of sawed lumber advanced while the construction of log cabins terminated.

However, there are certain advantages in the use of a log cabin for style and comfort, but also in the fact that in many wilderness areas where industry requires the attendance of a number of people, it is difficult to provide the kind of saw mill required to cut logs to the proper lumber size for conventional housing construction.

This invention describes a self-contained simple apparatus for efficiently handling logs of various diameters and lengths for the preparation of cylindrical logs modified with tongue and groove surfaces on top and bottom respectively, for the construction of homes or buildings. Such a self-contained apparatus is simpler and cheaper than the conventional type of saw mill and is, therefore, well adapted to be carried into wilderness areas for the construction of housing, particularly where there is plenty of timber of suitble size, etc.

In the prior art, logs have been prepared for the construction of log houses by the use of a more or less conventional lathe, in which the raw log was clamped between centers and rotated by the lathe head. Cutters were provided to travel along the lathe bed to cut the log down to a selected diameter. The logs were then moved to and put on a milling machine which was used to cut the flats on top and bottom and to provide the tongue and groove construction as desired. The logs were then moved to a third location to cut the saddle notches and to cut them to precise length, etc. All of this required separate handling and transport, was expensive and required considerable man power and machinery, and was, therefore, too expensive to be used commercially in competition with commercial housing construction.

SUMMARY OF THE INVENTION

It is a primary object of this invention to provide a self-contained machine for the complete machining of logs into finished log timbers, for the construction of log houses and buildings. It is a further object of this invention to provide a machine for the complete machining of logs for log houses without separate manual handling.

It is a still further object of this invention to provide means for turning the logs to a selected diameter; to provide separate means for collecting the chips of the bark of the logs, and the chips of the bark of the logs, and the chips of the white wood of the logs, since these are marketed separately; means to machine top and bottom surfaces of the log to provide adequate parallel seating of logs on top of each other and to provide and seal against the weather by means of appropriate tongue and groove construction; means to cut saddle notches, at desired locations, of various selected diameters; means to cut the logs to proper length, and to cut vertical notches in the ends of logs for the purpose of inserting door jams and windows, etc.

These and other objects are realized and the limitations of the prior arts are overcome by providing a unitary construction including a long pair of rails, rigidly mounted on a base structure. The length of the rails is somewhat longer than twice the length of the longest log to be prepared. A carriage is provided to run on the two parallel rails and the carriage is long enough to extend beyond the maximum length of the logs to be machined.

Means are provided for loading raw logs onto a platform and moving one log at a time horizontally, onto the machine, where they are loaded in a self-centering device. This device lifts the log up from below, and centers the log with the centers mounted on the carriage. The centers are pressed into the ends of the log and means are provided for rotating the centers so as to rotate the log at any selected speed.

Cutters are provided beneath the log, adjustable in distance from the axis of the log, so that by rotation of the log, rotation of the cutters, and translation of the carriage, the logs can be cut down to a cylindrical shape of selected diameter.

After the log is cut to a constant diameter, a second pass of the carriage is made past a pair of cutters, one above and one below the log. The cutters serve to cut flats on top and bottom with appropriate tongues and grooves for interlocking each of the logs in a vertical panel.

The log at this stage is supported on a vertically moving table so that it can be released from the centers and dropped down, to permit the passage of the carriage, which then proceeds to accept a second log, etc.

The log is then passed longitudinally on to a second table, which is provided with an adjustable stop, which can be set by a hydraulic control so that the logs can be cut to a selected length.

After the log is cut to length and grooved at one or both ends, as desired, it passes through a log slitter, which is essentially a large band saw that can be adjusted to any selected angle to slit the log into two pieces, which can be placed at the base or at the top of a wall as required.

Means are then provided for spraying the machined log with a wood preservative and stain, after which it is sent to storage.

BRIEF DESCRIPTION OF THE DRAWINGS

These and other objects and advantages of this invention and a better understanding of the principles and details of the invention will be evident from the following description taken in conjunction with the appended drawings, in which.

PREFERRED DESCRIPTION OF THE EMBODIMENT

Figure 1:
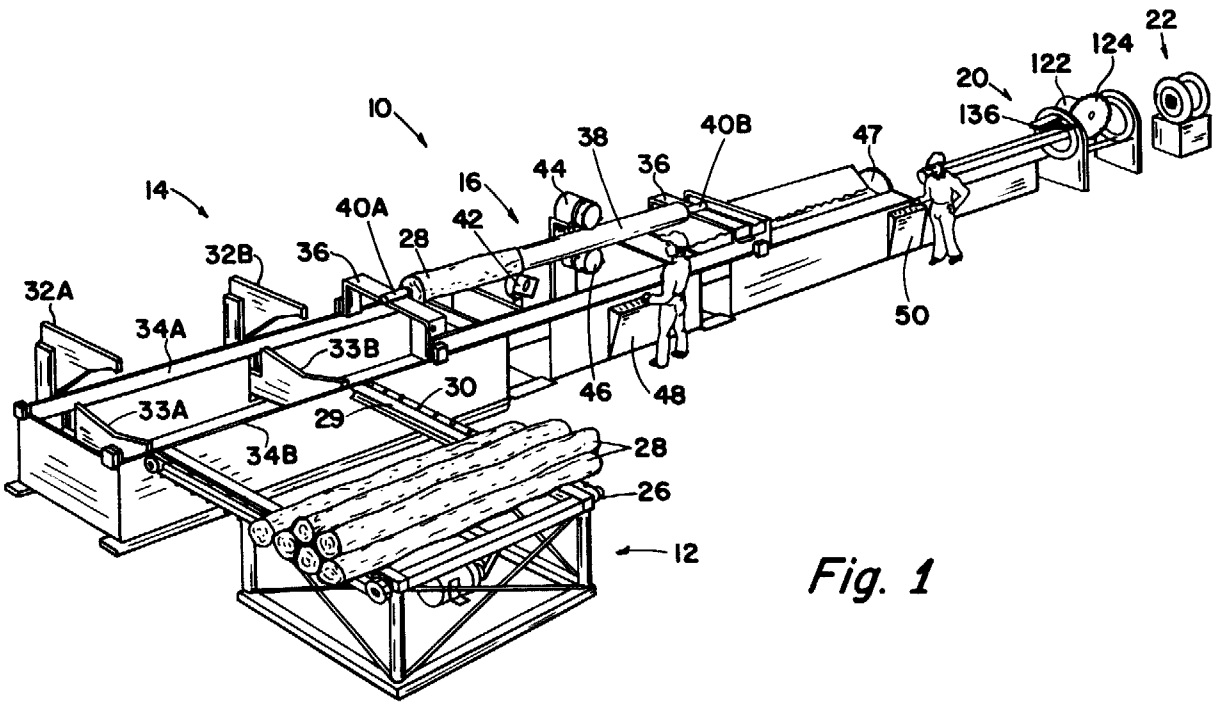
FIG. 1 is a copy of FIG. 1 taken from U.S. Pat. No. 4,047,350, which illustrates the overall machine in a general way.

Referring now to the drawings, and, in particular, to FIG. 1, there is indicated by the numeral 10 a general view of an early model of the machine of this invention. This will illustrate the overall layout of the machine and the various portions of the machine, each one adapted to carry out certain operations on the log.

FIG. 1 is taken from U.S. Pat. No. 4,047,350, which describes an early model of the log preparation machine, indicated generally by the numeral 10, of which this application is an improved version.

Illustrated generally by the numeral 12 is a raw log loading apparatus on which the raw logs can be piled, and by means of which they can be carried laterally along the track 29 by chain-drive means 30, etc., to a log-centering apparatus illustrated generally by the numeral 14.

The machine compresses a long, narrow, rectangular frame, which has a pair of top rails 34A and 34B, on which a carriage, indicated generally by the numeral 16, is supported and guided by means of rollers. Power means are provided for translating the carriage 16 longitudinally along the top rails of the main frame from a position where the frame is centered over the log-centering apparatus 33A, 33B and 32A, 32B.

When the raw log 28 is positioned in the notch of 33A and 33B the support plates 33A and 33B are lifted, while the plates 32A and 32B are lowered at an equal rate, so that the logs will then be centered in a plane which corresponds to the plane of the carriage centers 40A and 40B.

When the raw log 28 is positioned in the notch in the support plates 33A and 33B, these plates are in their lower position and, correspondingly, the upper plates 32A and 33B are in their upper positions. The carriage 16 is then moved to the left, where it is centered over the log. The support plates 33A and 33B are raised, and the support plates 32A and 33B are correspondingly lowered. The log is held in a position such that the axis of the log will correspond with the axis of the centers 40A and 40B of the carriage 16. The centers are then moved inwardly by hydraulic means, (not shown) and are pressed into the log. The log is then supported on the centers and the support plates 33A, 33B, 32A, and 32B are moved away to lower and upper positions, respectively, so that the carriage can then be moved longitudinally to the right in FIG. 1.

As the carriage 16 moves to the right, a first cutter 42 is lifted into position and cuts the log to a selected diameter. In the improved machine there are two cutters, which sequentially cut the log down to the selected finished smooth outer circumference. As the carriage moves completely to the right the log is then completely cut down to its finished circular contour. The cutters 42 are withdrawn, and the log carriage is moved back to the starting point, at the left.

A second set of cutters 44 comprising two separate cutters, one adjustable upwardly from below and the other one adjustable downwardly from above, are positioned at equal distances below and above the axis of the log. A lock is driven into one end of the log, which prevents its rotation. A second traverse of carriage 16 is carried out to the right, with a pair of cutters 44 operating to cut the top and bottom surfaces of the log. U.S. Pat. No. 4,047,350 illustrates a preferred contour of the top and bottom surfaces by means of which a much-improved seal against passage of air or water into the space between the logs is prevented.

Figure 6:
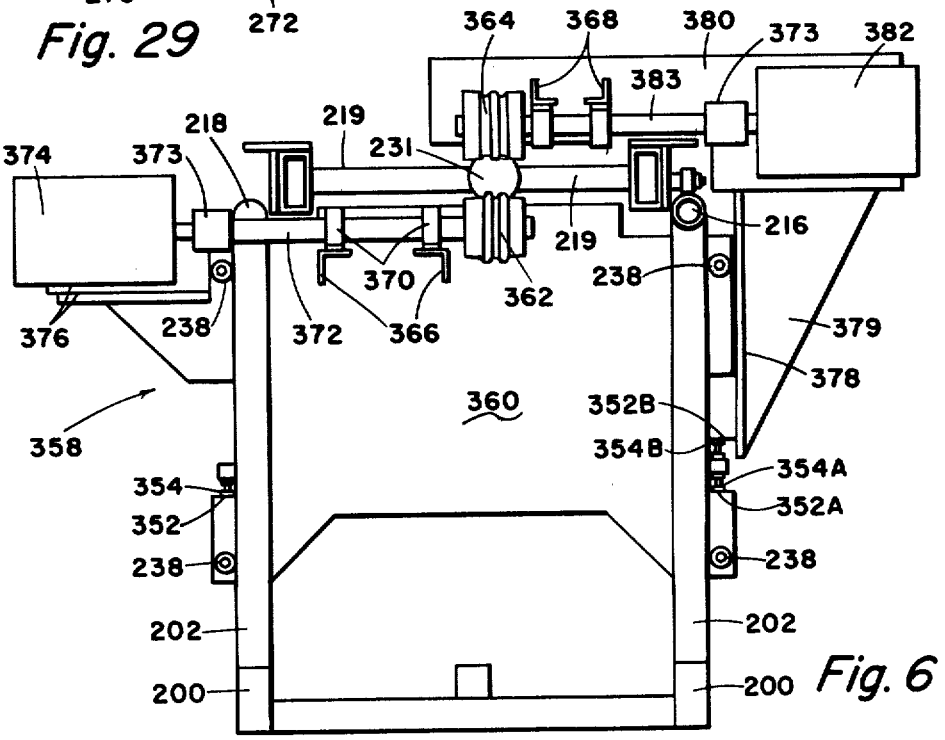
FIG. 6 illustrates apparatus for simultaneously machining the top and bottom surfaces of the log while the log is held rigidly in center in the carriage.
Figure 11:
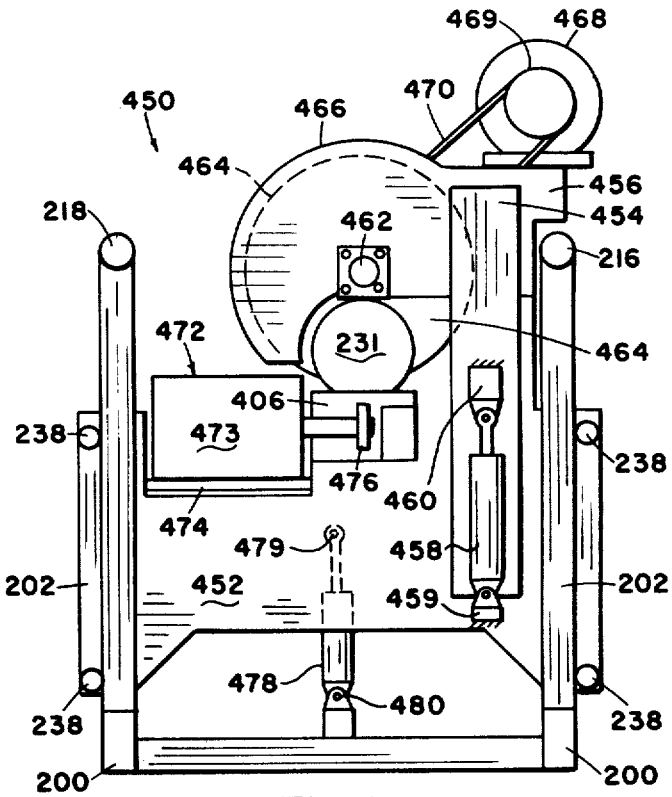
Figure 14:
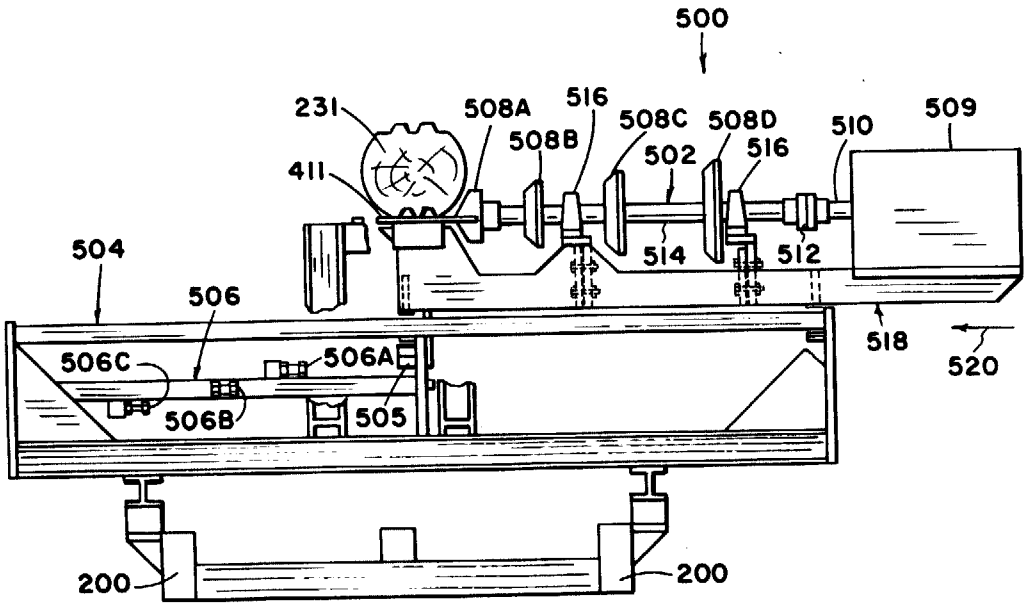
FIGS. 14 and 15 illustrate two views of the saddle notch cutting apparatus.

Shown very schematically in FIG. 1 are additional stations, such as with additional cutters such as 47, for example, which will be illustrated in FIGS. 6, 11, and 14, for cutting the first end of the log square, cutting a vertical notch in the end of the log and cutting a saddle notch at a selected distance back from the end of the log.

Figure 21:
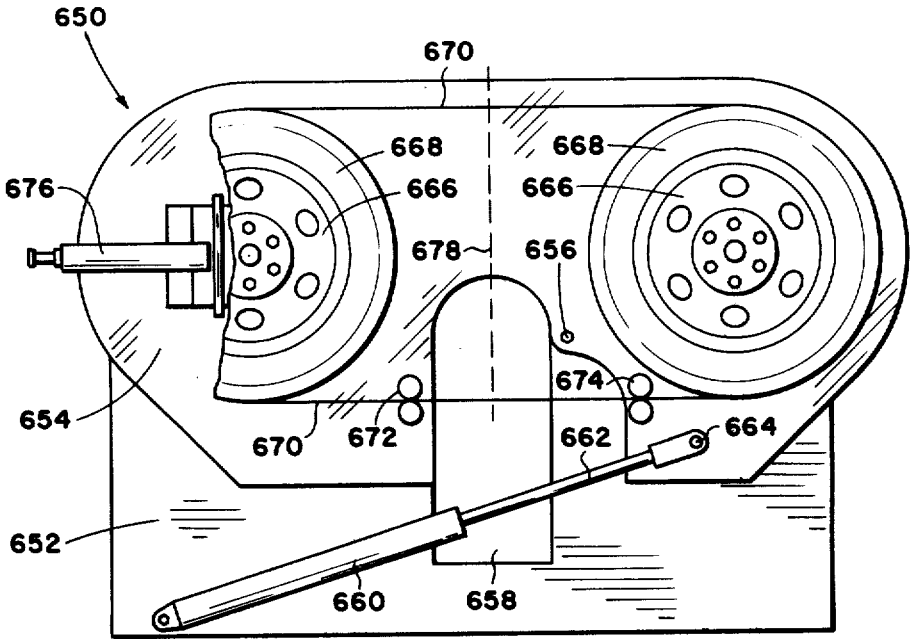
FIGS. 21, 22, and 23 illustrate the log slitting apparatus of this invention.
Figure 22:
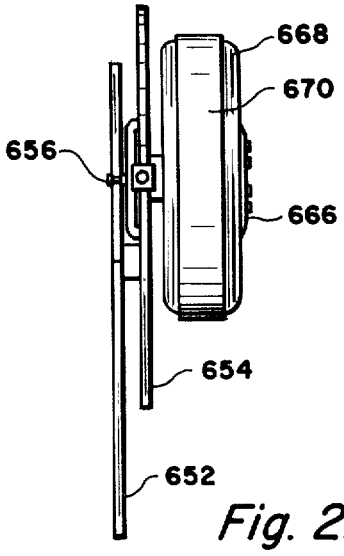

There is a log slitter indicated generally by the numeral 20, which is illustrated in the FIGS. 21 and 22, and a means 22 for spraying a protective liquid onto the freshly-machined log.

The improvements of this machine, over that illustrated in FIG. 1, lie in improved means for manufacture, to simplify the adjustment and maintenance of the apparatus, and to minimize the cost of manufacture. What is provided by the details of this machine, is a manner of construction of a machine capable of great precision of processing, although manufactured by imprecise machines. That is, although the parts individually are imprecise, means are provided for adjusting them with great precision so that the log product can be manufactured to a high precision on a machine of great strength, rigidity, and minimum cost.

Figure 2:
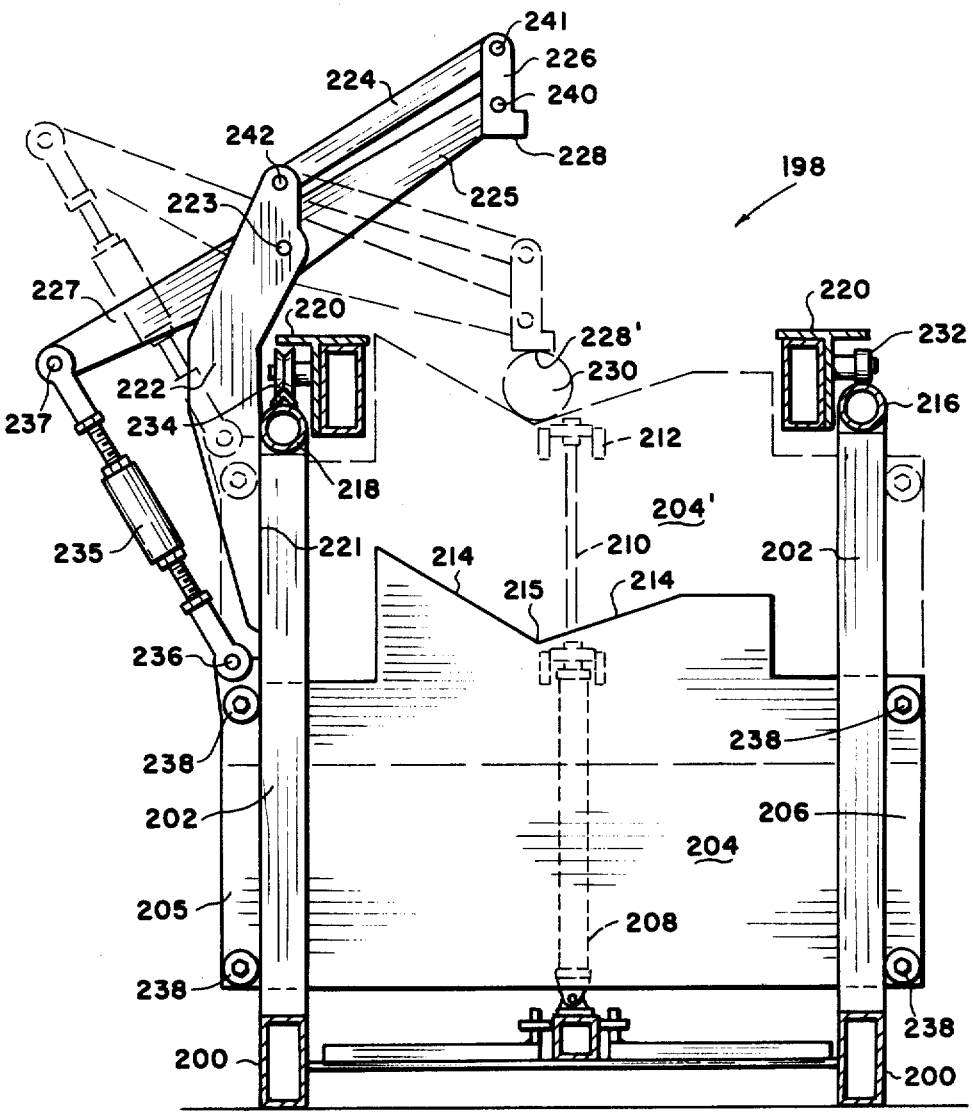
FIG. 2 illustrates an improved version of the apparatus for centering a log in the carriage.

Referring now to FIG. 2, there is indicated generally by the numeral 198 an improved version of the log-centering apparatus 14 of FIG. 1. This log-centering apparatus has a support plate 204, which is guided in vertical planar motion, by two upright posts 202. These are made of square tubing, and are welded at their bottom ends to rectangular tubing 200, which forms the long frame of the machine.

In this improvement there is only one support plate 204, which is guided by the upright columns 202. The plate 204 is wider than the width between the outer surfaces of the columns by a selected amount, 205 and 206. Adjustable rollers 238 are mounted to the plate, and adjusted inwardly or outwardly, until the plate runs vertically on those rollers bearing against the outer surfaces of the columns 202 with a minimum of clearance, etc.

Figure 29:
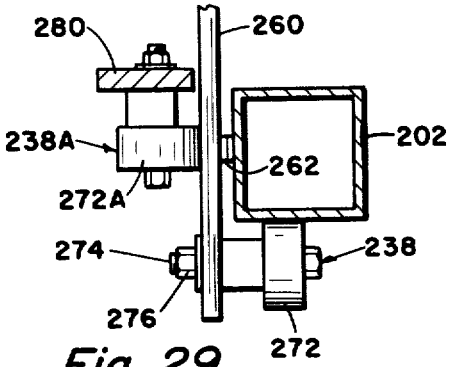
Figure 27:
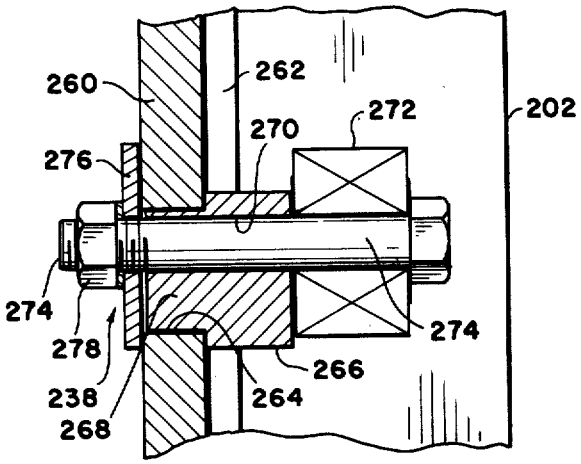
Figure 28:
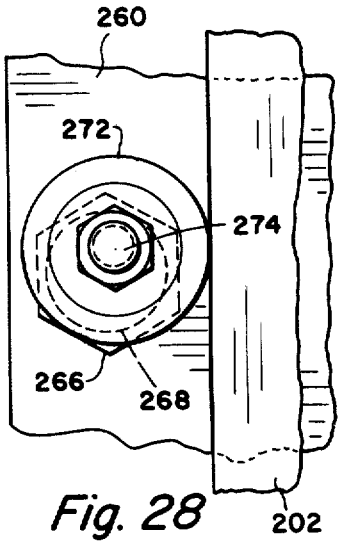
Figure 30:
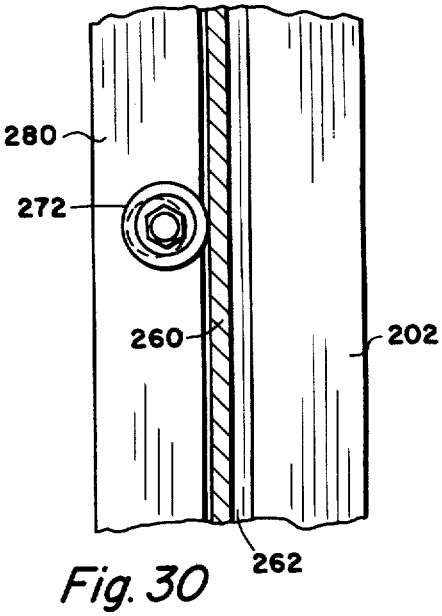

The details of how these rollers 238 operate is shown in FIGS. 27, 28, and 30. The support plate 260 which corresponds to plate 204 of FIG. 2, runs in contact with a thin rubbing strip 262, which is welded to the square tubing column 202. This will be described in connection with FIGS. 29 and 30. Near the outer edge of the plate 260 is a cylindrical bored opening 264. An eccentric bearing of hexagonal steel rod 266, 268 is turned down at one end 268 to be a proper fit into the bored opening 264. The remaining portion 266 is hexagonal.

A longitudinal drilled opening 270 is cut into this bearing 266, 268, but is off center from the cylindrical portion 268. A bolt 274 is provided, and a rotary bearing 272 is placed over the bolt, which is passed through the bearing 266, 268. The bearing 266, 268 is held in the bored opening 264 by means of a washer 276 and a nut 278. By tightening the nut 278 the bearing is held immobile in the opening 264, and the bearing 272 then rotates on the bolt which clamps the inner race of the bearing.

If a lateral adjustment of the plate 204, for example, is required, then the nuts 278 are loosened, the hexagonal bearing 266, 268 is rotated slightly in one direction or the other, which, by reference to FIG. 28, indicates that the bearing outer surface 272 will then move closer to or farther away from the wall of the column 202.

Thus, it is seen that limited precision is required in the positioning of the opening 264 in the plate 260 since, as fine an adjustment as desired can be obtained by the rotation of eccentric bearing by means of a wrench after it is installed in position. The eccentric nature of the adjustment is illustrated clearly in the dashed portions of FIG. 28, and no further description is required.

Referring now to FIGS. 29 and 30, there is an additional need for means to hold the support plate 260 in contact with the bearing or rubbing strip 262 on the surface of the column 202. As previously mentioned, the square tubings 202 serve as columns for the support of the upper rails of the frame, and also form the tracks on which the support plates, such as 260, are guided in a vertical planar motion.

A support rod 280 is attached by bolts at its bottom end to the bottom rail 200, and the top end to the same rail to which the column 202 is welded. Some lateral adjustment is thus permitted in bolting the vertical support rod shown in cross-section 280 for general positioning with respect to the column 202. However, by using another of the assemblies 238, such as 238A, as shown, mounted in an opening 264 in the vertical support rod 280, the clearance between the roller 272A, the support plate 260, and the rubbing strip 262 can be adjusted, and the plate will then roll freely upwardly and downwardly, being guided in one direction by the wall of the column 202, and on in the other direction by the rubbing strip 262 of the column. These eccentric roller assemblies are thus used as a means for precision alignment and guiding of the support plates, without need for precise measurements between machined parts, etc.

Returning now to FIG. 2, and recalling the operation of the eccentric roller assemblies of FIGS. 27, 28, 29, and 30, it will be seen that the support plate 204 can be moved vertically in a co-planar manner under the force of a hydraulic cylinder 208 supported at its bottom end to the frame and at its top end to the support plate at 212.

At the top of the main frame there is a circular tubing 216 which forms one rail, and a circular tubing with an angle welded on top of it, which serves as a second rail, both of which are horizontal and parallel to each other. The construction of the rail 218 is different but mechanically identical to the design of FIG. 3, in which a square tubing is welded as the top rail instead of the circular tubing plus the angle. The objective here is to provide two rails, one on which a flat roller 232 can run, and another on which a grooved roller 234 can run, and be guided laterally at the same time. The structure 220 indicates the longitudinal members of the carriage shown generally as 16 in FIG. 1. There are cross members 36 which are not shown in FIG. 2, but are well understood from FIG. 1.

By reference to FIG. 1, it will be clear that there are two assemblies 198 like those shown in FIG. 2. These are spaced apart by a suitable dimension which is less than the length of the raw logs.

There is an upwardly extending arm 222 which can be welded 221 to the edge of the column 200. This arm 222 includes bearing positions 223 and 242, for a pin which supports a rocker arm 227, 225, and a pin which supports a shorter arm 224. There is a short vertical bar 226, having a contact surface 228, which is pivoted at points 241 and 240, which are equally spaced, and parallel to the pins 242 and 223. Thus, as the rocker arm 227, 225 rotates, the bar 226 will remain vertical and will move, more or less, parallel to itself, and in an up and down position. An adjustable length arm 234 pivoted at 237 to the arm 227, and at 236 to the plate 204, serves in an approximate way to bring the contact surface 228 downwardly to the position 228' to bear against the log 230, as the notch 215 moves upwardly supporting the log. Thus, the combination of the upwardly moving support plate 204 and the linkages just described will serve to hold the log 230 in a position which will be within the horizontal plane of the centers of the carriage.

While the mechanism of FIG. 2 is not as precise as the mechanism of FIG. 1 for centering the log, it has been found that it is much simpler to construct and, in view of the non-cylindrical character of the raw logs, it is sufficiently precise to roughly center the logs so that a log of maximum diameter can be cut from a deformed, bent, or otherwise misshapen log.

What has been described is a simplified, more easily adjusted and less costly version of the apparatus of FIG. 1, for accepting a raw log, positioning it in the horizontal plane of the centers, and centering it coaxially with the centers of the carriage.

Figure 3:
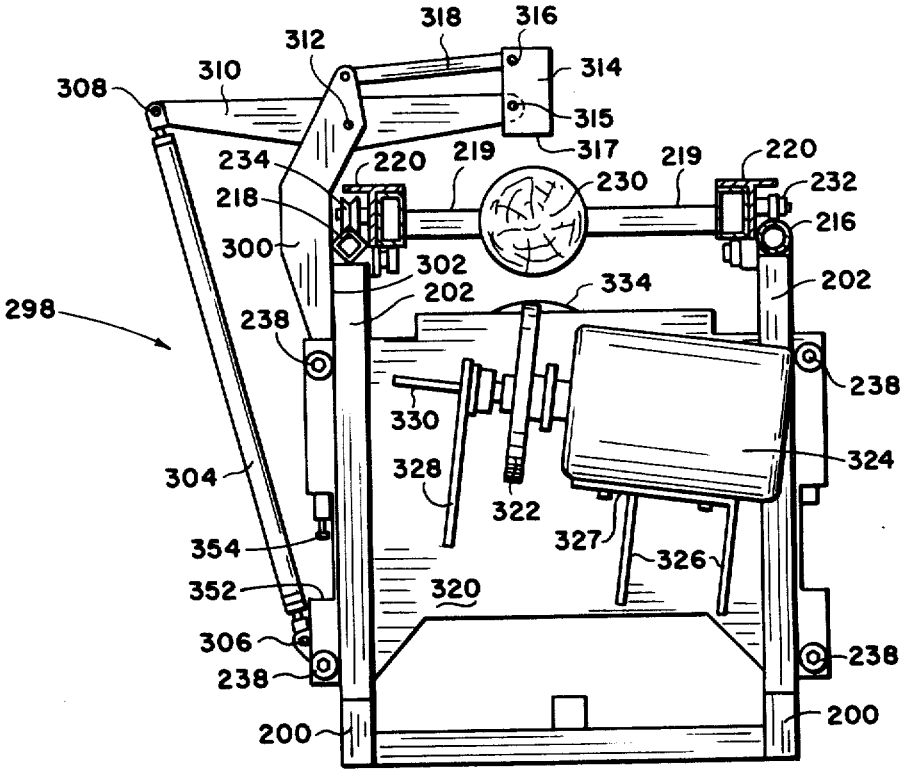
FIGS. 3, 4, and 5 illustrate different views of an apparatus for machining the log to a cylindrical contour of selected diameter.
Figure 4:
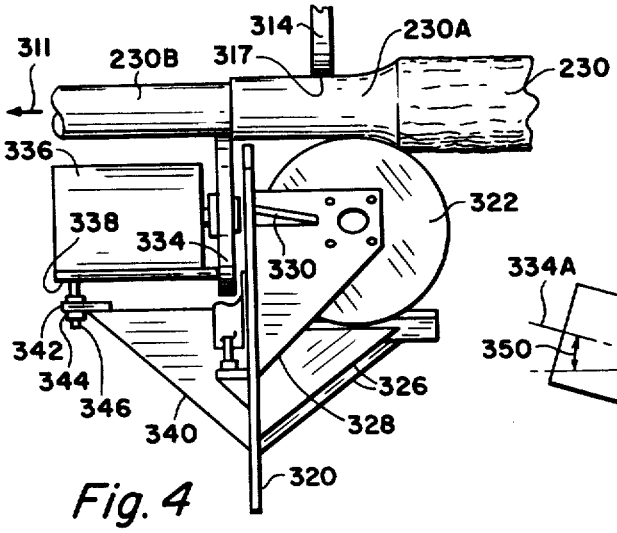
Figure 5:
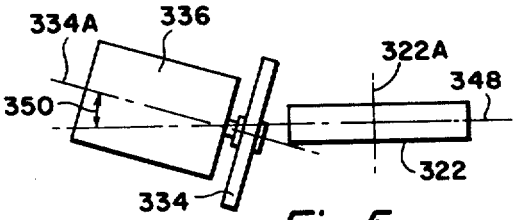

Referring now to FIGS. 3, 4, and 5, there is shown in different views, details of the first rotary cutters indicated generally by the numeral 298, and in a general way in FIG. 1 by the numeral 42.

There are two sets of cutters, which, together, cut the rough log down to a selected final diameter in two stages. A first cutter 322 is mounted on a shaft 330 of a motor 324. The motor is supported on a framework 327 which is attached to a support plate 320 by means of brackets 326 and 328. The first cutter 322 has an axis which is generally directed transverse to the axis of the log 230, which is supported in the carriage structure 220. A second cutter 334 is supported on the shaft of a second motor 336, which is attached to support bracket 340 and to the support plate 320. The two motors and cutters are on opposite sides of the support plate 320, and are individually set so that, after the support plate 320 is lifted to the proper elevation, cutter 322 will produce a first cut 230A on the log 230 and the second cutter 334 will provide a finishing cut down to a second selected diameter 230B.

The support plate 320 is supported by means of the two columns 202 in a manner similar to the support plate 204 of FIG. 2. That is, the support plate is guided by eccentric roller mechanisms 238 so as to be properly aligned for free rolling vertical planar motion. It is also held in contact with the column 202 in the manner illustrated for FIG. 2.

As shown in FIG. 3, there is an upwardly extending arm 300, which is welded 302 to one of the two columns 202. Furthermore, as in FIG. 2, there is a tilting arm 310 rotating about an axis 312, which is controlled by an extensible arm 304, which is hinged at point 306 to the support plate 320 and at point 308 to the arm 310.

The arm 310, in cooperation with a shorter parallel arm 318, supports a plate 314 that has a bottom bearing surface 317, such that, as the support plate 320 rises, the contact surface 317 of the plate 314 will drop. The surface 317 is adjusted so as to press on the back, or upper surface, of the machined portion 230A of the log 230. This is illustrated in FIG. 4 where the plate 314 is shown in contact with the log as the cut is being made.

The purpose of this pressure on the top surface of the log is to hold the log in contact with the cutter and to avoid chattering, and improper cutting of the log. This acts as a backrest in a conventional lathe operation, where a heavy cut is being made and the work is thus restrained at the point of pressure of the cutter.

Referring briefly to FIG. 5, the rough cut cutter 322 is shown with its axis 322A at right angles to the center line 348 of the log. On the other hand, the second cutter 334 is rotated on an axis 334A, which is roughly directed longitudinally of the log. However, it has been found that, in the finished cut, down to the final diameter 230B of the log, that a small angular rotation of the cutter indicated by the numeral 350 provides a much smoother surface cut, and, thus, the adjustments for angle 350 is provided in the support structure 342, 344, 346, etc. of FIG. 4 for the motor 336.

It will be clear from FIG. 4 that the direction of motion of the carriage and the log 230, with respect to the cutters 322 and 334, is to the left, in the direction of arrow 311.

Referring to FIG. 3, there is an adjustable stop 354, which will be described more fully in later description, which provides a stop for the ledge or edge 352 of the support plate 320, as it is brought up to position the cutters with respect to the log.

In the use of this log machining device, provision is made for machining logs of different diameters since there are different applications for logs of say 6, 8, 10, and 12 inches diameter. Consequently, in machining the logs, the support plate 320 would have to be raised to different positions depending on the size of the log to be cut. Instead of raising the support plate 320, by means of a micrometer control, it has been found desirable to provide the mechanical stops which are of sufficient strength and rigidity that the hydraulic valve can be opened, lifting the support plate, and holding it tight against the stop. However, there must be at least four different stops that can be positioned sequentially to control the positioning of the support plate. All of this will be described in more detail later, except to point out here that the stops 354 will co-act with the edge 352 to position the support plate, such that the cutters 322 and 334 are in the proper position for a selected diameter of finished log 230.

Referring now to FIG. 6, there is shown a view of a second set of cutters, indicated generally by the numeral 358, the cutters for preparing the top and bottom surfaces of the logs. As has been previously described, once the log has been turned to its final circular diameter by the cutters of FIGS. 3, 4, and 5, the log must then be locked against rotation while still supported in the centers of the carriage.

Figure 32:
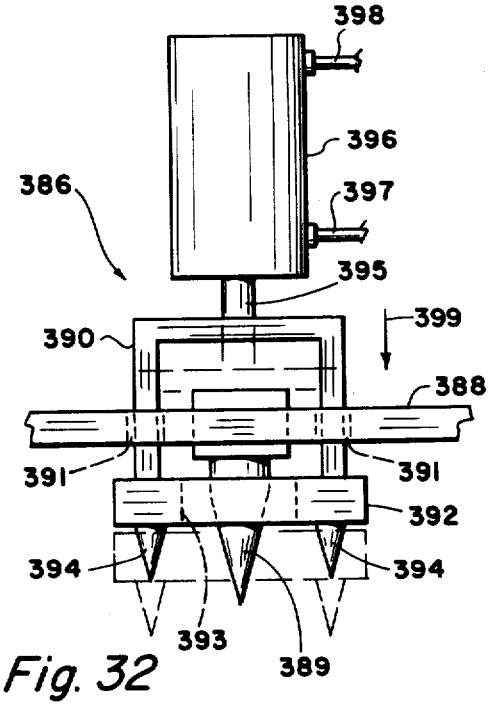
FIG. 32 illustrates a detail of means for locking the log against rotation, while mounted in centers in the carriage.

In FIG. 32 is illustrated a method of an apparatus for locking the log against rotation. Indicated generally by the numeral 386, is the locking fixture. It is mounted on one end of the carriage indicated by the bar 388, which is shown holding one of the centers 389. A U-shaped yoke 390 has two arms which pass through openings 391 in the cross-bar 388 of the carriage. Arms 390 terminate in a bar 392, which has an opening 393 to provide clearance around the center 389. There is a plurality of sharp points 394 in the bar 392. The yoke is supported by a piston rod 395 in a cylinder 396. When hydraulic pressure is applied to the opening 397, the yoke, with its bar 392 and points 394, will be pulled back from the log, which will be supported on the end of the center 389. However, when hydraulic fluid is supplied to the opening 398 the piston rod will be moved in the direction of the arrow 399 and will be driven into the end of the log, and will prevent the log from rotating.

As shown in FIG. 1, there are two cutters 44 and 46, one operating on the top of the log, and the other on the bottom of the log, in order to provide the two matching surfaces, by means of which a vertical series of logs can be sealed.

In FIG. 6, there is one support plate 360, which is mounted in relation to a pair of columns 202 in a manner similar to FIG. 2. This carries a motor 374 supported on plates 376, attached to the support plate 360. There is a shaft 372 coupled by means 373 to the motor shaft, and guided by bearings 370 in brackets 366, attached to the support plate 360. The cutter 362 is mounted on this shaft and has appropriately contoured blades, to provide a special surface for the underneath portion of the log 231 which has a pair of grooves.

There is a second cutter 364, which is mounted on a second support plate 380, which is attached by bracket plate 379 to a support plate 378. The support plate 378 is similar to 360 except that its plane is parallel to the length of the frame of the machine, and is supported by two columns like 202, which are attached to the frame along the length of the frame.

The reason for this change of angle is that the two cutters 362 and 364 operate one directly above the other, and the use of the two support plates 360 and 378 positioned at right angles permits this vertical planar alignment of the two cutters.

In operation the lower cutter 362 mounted on the support plate 360 is brought up from below until the edge 352 is pressed against the stop 354, and edge 352A is pressed against the stop 354A. The cutter 362 is now in position for cutting to final dimension of a selected diameter according to the particular stop 354 that has been positioned in line with the edge 352.

Similarly, although not shown, there is a hydraulic means for raising and lowering the support plate 378, and there are corresponding stops 354B, which limit the downward position of the edge 352B, such that the cutter 364 will be in the proper position for cutting the pair of tongues on the top surface of the log 231.

Not shown, but present, are two hydraulic cylinders, one arranged to lift and lower the support plate 360 and another one for lowering and lifting the support plate 378. These are conventional.

In operation the proper stops according to the size of the log are selected and positioned. The hydraulic control valve is opened to both cylinders, and they independently position their respective support plates against the appropriate stops, which precisely positions the cutters 362 and 364, respectively. Since the stops themselves are constructed with a threaded rod for micrometer adjustment of the position of the stop, a very precise dimensional control is possible on the cut surfaces of the logs.

After the cutters 362 and 364 have been set, and the carriage has moved completely to the right, and the log has moved completely past the two cutters, the carriage is stopped. Positioned in the space beneath the carriage is a table mechanism illustrated in FIGS. 7, 8, 9, and 10, and indicated generally by the numeral 400. The narrow table 406, which is, more or less, in the form of a beam, and has two rollers 424, one at each end. One of the rollers is driven by a hydraulic motor 420. There is a belt or chain which surrounds the table and passes around the rollers, or sprockets, 424A and 424B.

The table is supported by two pairs of legs 402 and 402A, at one end and 403 and 403A at the other end. The legs are supported in pivots 408 and 409, respectively. The legs are pivoted about shafts 404 and 405, respectively, so that by use of a hydraulic cylinder 414, pivoted to a strap 412 across one pair of legs, the table can be lifted to the dotted position 430 with the leg 403 in position 403' against stop 416. In this position the surface of the belt at 430 will just be slightly below the bottom surface of the log being held in the centers in the carriage.

With the table in the raised position, just described, the centers of the carriage are pulled back from the log, which releases the log from the carriage, and positions it on top of the belt on the table.

By lowering the table by releasing hydraulic fluid from the cylinder 414 the table drops from the upper stop 416 down to the lower stop 418, where the top surface of the table is on the level with table structure 411 and a second colinear table, indicated generally by the numeral 434. The table 406 and its support legs are supported by a structure 410 to the frame 200.

Having completed the longitudinal shaping of the log, the next steps are to provide additional cuts—that is, cutting the leading end of the log square, and the trailing end, to provide the desired length of the log, and cutting vertical grooves in the ends of the log, and, as necessary, cutting saddle notches near the ends of the log. This is generally indicated by the cut-off saw 450, the vertical grooving cutter 472, and the saddle notching cutter 502, which will now be described.

Figure 12:
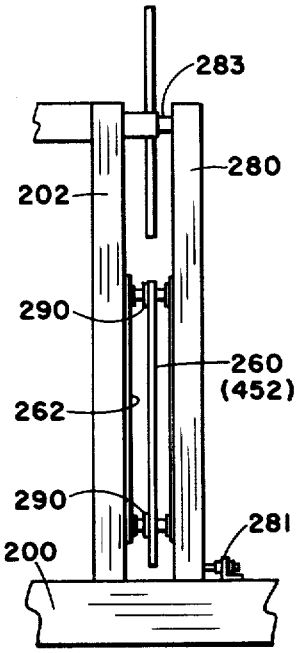
FIGS. 11, 12, and 13 illustrate three views of the multiple cutting apparatus, including the cut-off saw and the vertical groove cutter.
Figure 13:
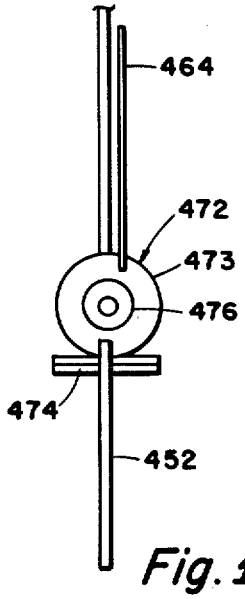

Referring now to FIGS. 11, 12, and 13, there are shown several views of a multiple cutter apparatus, which includes a cut-off saw indicated generally by the numeral 450, and a vertical notching cutter indicated generally by the numeral 472.

A support plate 452 is supported by the columns 202, in the manner which has been described previously, including the eccentric roller assemblies 238, and hydraulic control cylinders 478 and 458. Motor 473 is mounted on table 474, which is attached to support plate 452. The vertical grooving cutter 476 is mounted on the shaft of the motor 473. This vertical groover assembly is identified generally by the numeral 472.

Mounted on one side of the support plate 452 is a track structure 454 (detail not shown) which carries a support plate 456, which supports a drive motor 468, which drives, by means of pulley 469 and belt 470, a circular saw blade 464, which is housed inside of a circular shield 466. This circular saw 464 is the cut-off saw for trimming the ends of the logs to a perfectly square surface at a precise length. The second support plate 456, which is carried by the mechanism 454, is moved vertically relative to the support plate 452 by means of a hydraulic cylinder 458, which is supported at one end 459 to the support plate 452 and at the other end is supported by the mechanism which carries the support plate 456.

Figure 31:
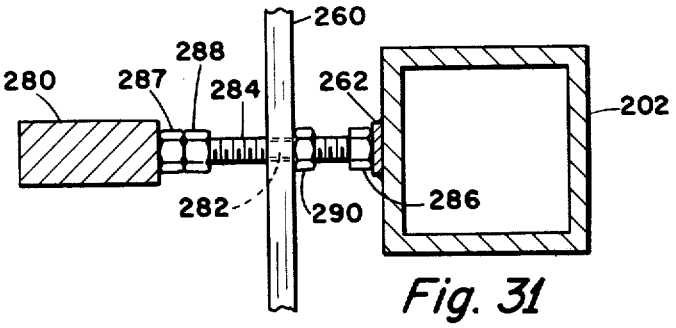
FIGS. 27, 28, 29, 30, and 31 illustrate various details of means for laterally guiding, in vertical motion, the support plates, which support the various cutters used in shaping the log.

In FIG. 12 is shown an end view of the support plate 452, (260), which is positioned between a pair of columns 202, one of which is shown in FIG. 12. The columns are welded to the longitudinal rails 200 of the main frame. There is also a vertical support rod 280, which is shown in FIG. 29, and is shown more clearly in FIG. 31, to which reference is made. The support rod 280 is adjustably attached to bolts to the frame at the bottom and top. As shown in FIG. 31, there is a rubbing strip 262 on one face of the column 202 as previously described. In the case of the support plate 452, it is important not only to have a free-moving structure that can be raised and lowered but, because of the importance of a perfectly square cut on the end of the log, the support plate 452 must be adjusted by tilt in two directions to be perfectly square with the axis of the log as it is dropped on the receiving table 400.

There are four bolts 284 (FIG. 31) threaded through the support plate 260. The head 286 on one end of the bolt presses against the rubbing strip 262 and there is a pair of nuts 287, 288, on the other end of the bolt, which rub against the edge of the support strip 280. By loosening the lock nut 290 and rotating the bolt 284 by means of a wrench on the head 286, a very fine adjustment of the angular position of the plate 260 can be made. When all adjustments are correct, the lock nuts 290 are tightened, which maintain the position of the saw with respect to the log which has just been dropped from the centers of the carriage, onto the table.

Referring now to FIG. 13, there is shown a transverse elevation of the support plate 452 and the table 474, which supports the motor 473, which carries the notching cutter 476, which cuts the vertical groove in the end of the log. The plane of the saw is represented by 464.

In operation the saw is raised by means of cylinder 458 and the support plate 452 is lowered, bringing the saw down against the log 231. The cylinder 458 then pulls the saw full way to the bottom, so that it is completely through the log. With the log is position the support plate 452 is now brough upwardly, which engages the cutter 476 into the freshly-cut end of the log, providing a notch, if called for in the construction of that particular log.

Figure 15:
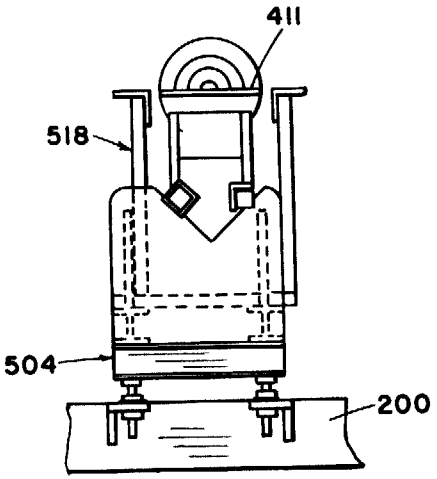

The third cutter in that group of cutters is the saddle notch cutter, which cuts a semi-circular groove transverse to the log near one end, so that the ends of two logs can fit one over the other, in a right angle position. FIGS. 14 and 15 illustrate the type of structure and construction of the saddle notch cutter. Again, the numeral 200 indicates the longitudinal base rails of the frame. There is a small transverse frame 504 resting on and attached to the main rails 200. In the structure 504 there is a pair of longitudinal rails on which a second structure 518 can be rolled or slid in the direction of the arrow 520. This can be done any way desired, but is preferably done by means of a hydraulic cylinder (not shown) but well understood in the art. Again, 231 indicates the presence of a log on the table 406. There is a plurality of circular cutters 508A, 508B, 508C and 508D, each of increasing diameter, being equal to the specific sizes of logs, which will be manufactured, namely, 6, 8, 10, and 12-inch finished diameter. A motor 509 has its shaft 510 coupled by means 512 to a shaft 514, which is suspended in bearings 516 in conventional manner.

By traversing the assembly of cutters 502, which are mounted on the shaft 514, on the frame 518, and moving the assembly to the left, then one or the other of the cutters will engage the log 231. A series of stops 506A, 506B, 506C, etc., are arranged on a horizontal rod adapted to be rotated by 90° steps so that one or the other of the three or four stops will intercept the fixture 505, which is attached to the movable frame 518. Thus, by rotating the shaft that carries the stops, so that the proper stop is in position, the frame 18 is driven to the left until the fixture 505 hits the desired stop. The desired cuter 508 will then have progressed through the log 231, cutting the desired diameter of opening of saddle notch.

FIG. 15 which is an end-on view of the framework 504 is self-explanatory.

Figure 7:
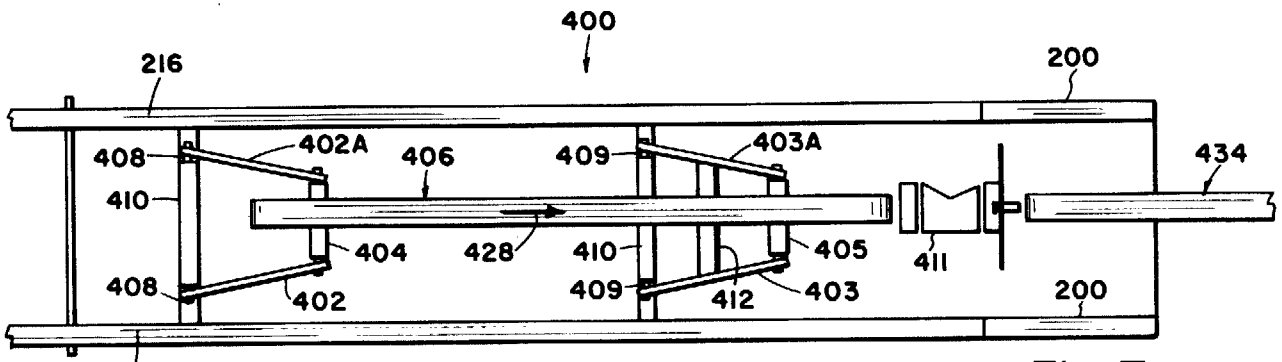
FIGS. 7, 8, 9, and 10 illustrate view of a table apparatus which is positioned under the carriage to accept the machined log as it is released from the center, and to lower it to a selected position and transport the log longitudinally to the multiple cutting apparatus.
Figure 10:
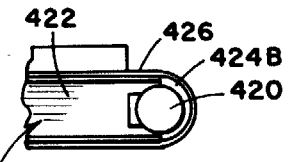
Figure 9:
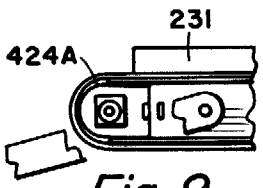
Figure 8:
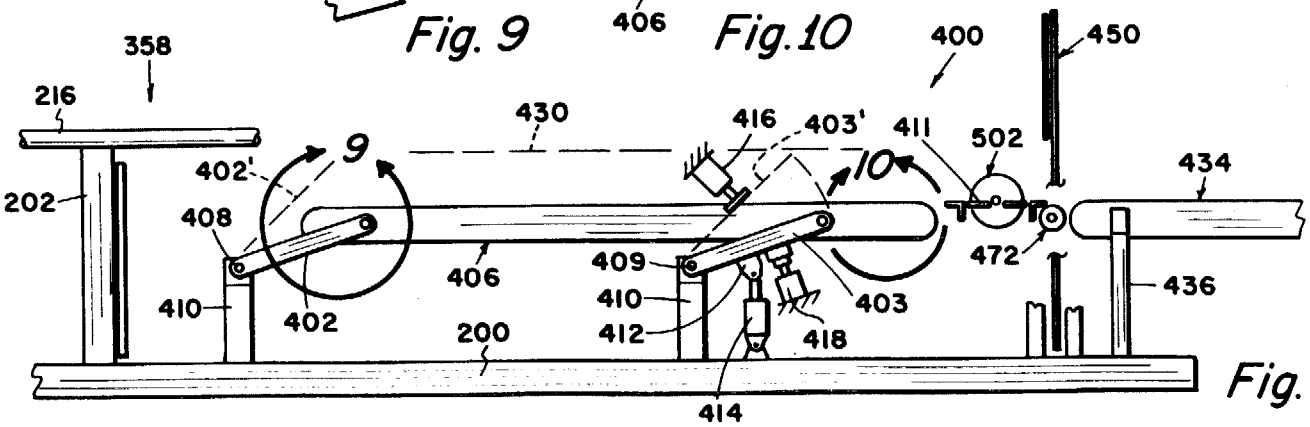

In previous discussion of FIGS. 7 and 8, it was explained how the log after machining, while on centers on the carriage, is lowered to the table 406, while in the raised position. The table is then lowered to the level of a second table 434. By rotating the motor 420, the belt or chain which supports the log 231 on the top surface of the table moves to the right in accordance with arrow 428 of FIG. 7 and carries the log with it into a selected position related to the cutters 450, 472 and 502.

As a first step, the leading edge of the log is brought to a stop slightly beyond the position of the cut-off saw 450 and the end of the log is trimmed square. An adjustable log stop, which is attached to the second table 434, and will be explained in connection with FIGS. 16 and 17, is set to a selected distance from the saw so that when the log being carried by the table 406 is transferred to the table 434 and carried down the second table, it will hit that stop, and will be in position then for the saw blade 464 to be brought down to cut it off at a second end at a predetermined length.

The log stop mechanism is a very important part of the construction of this system, inasmuch as there are logs of various lengths required in the construction of a housing unit and, in view of the fact that some of the raw logs are not suited to form a long, smooth contour, cylindrical log, because of previous curvature, or bad shape or limb structure. Portions of logs will be salvaged by using them for the shorter length logs that are required in the structure.

Figure 16:
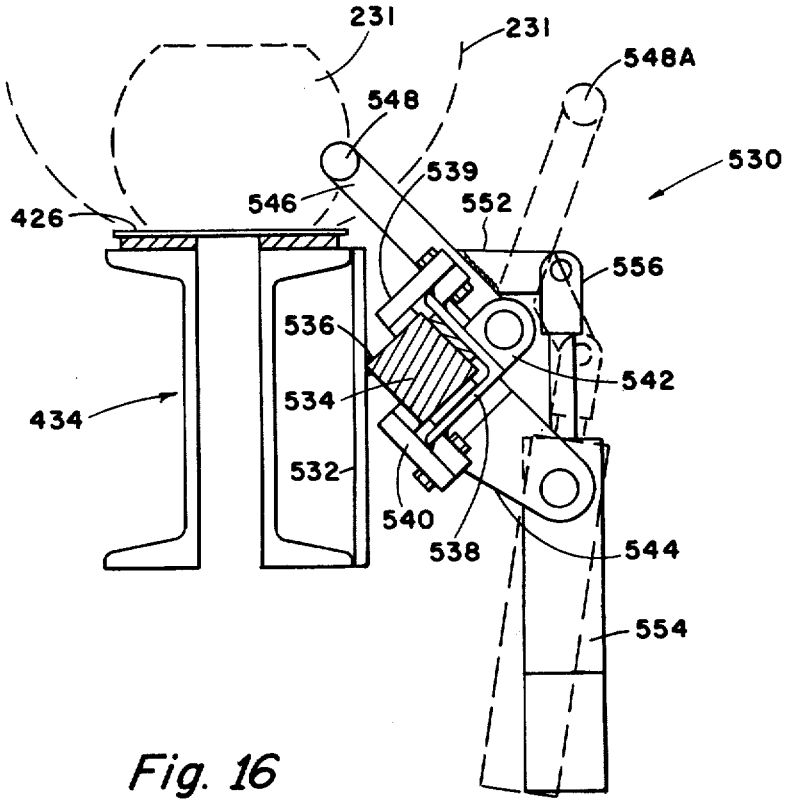
FIGS. 16 and 17 illustrate details of one embodiment of an adjustable log stop, for precise positioning of the log in the multiple cutting apparatus.
Figure 17:
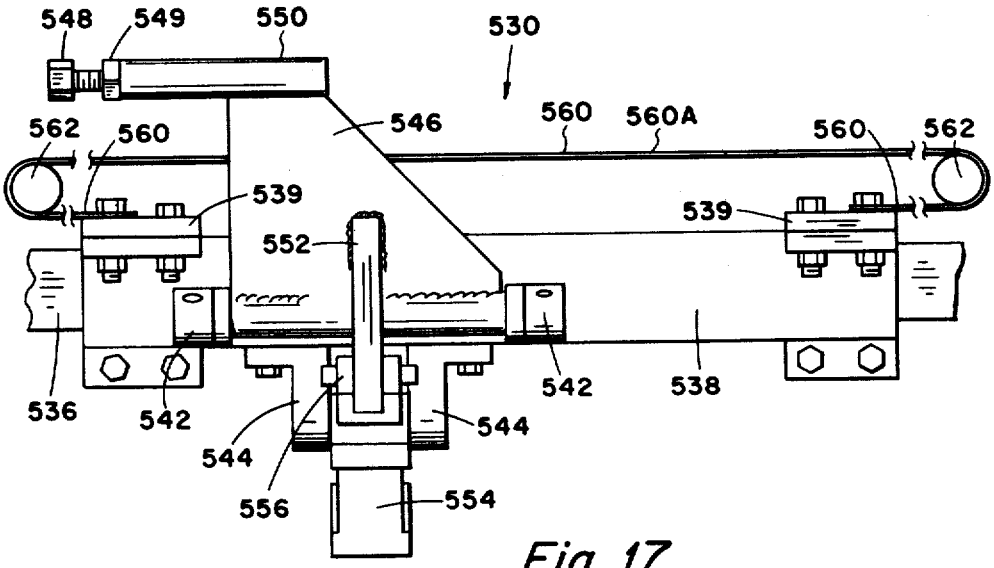

One type of log stop is illustrated in FIGS. 16 and 17. In FIG. 16, 434 indicates generally the second table, with a belt 426 on top and the log, such as the 6-inch or the 12-inch, as shown in dashed outline. Along the side of the table is a mounting plate 532, which carries a square bar 534, which is welded as at 536, to the support plate. A mechanism indicated generally by the numeral 530 is built around an angle member 538 with two plates 539 and 540 bolted to the angle member, so that there are four rubbing surfaces, one of which bears on each of the sides of the square rod. The plates are shimmed properly, so as to provide free longitudinal movement of the assembly 530 along the square rod.

As shown in FIG. 17, there can be a metal strap or chain 560, which is used as a driving member around two rollers or sprockets 562, with appropriate motor, to position the stop element 548 at any position along the second table. Also, it is convenient to have a measuring tape 560A in the same type of position as the drive tape 560 so that the operator at a selected position along the table 434 can read the precise position of the stop element 548 from the plane of the saw. By noting the reading on the measuring tape he can preset the stop to provide a log of any desired length.

To reset the stop, the arm 546, which is hinged in bearings 542, is pulled back to the position 548A by means of a small pneumatic or hydraulic cylinder 554, operating through the piston rod 556, onto the arm member 552. By use of the hydraulic cylinder 554, the stop arm is pulled out and the arm then is moved down along the table 434 to the precise position where the end of the log is to be positioned and the cylinder then replaces the stop arm and stop element 548 in the position indicated, to intercept the end of the log as it is carried down the table. The hydraulic motor that drives the belt on the table is underpowered, so that, as soon as the log hits the stop, it remains at that position.

Figure 18:
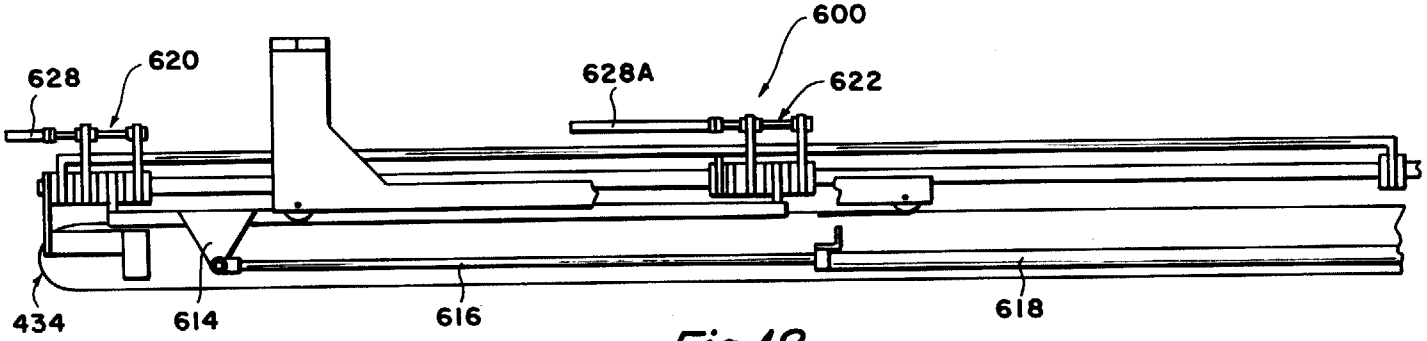
FIGS. 18, 19, and 20 illustrate a second embodiment of the adjustable log stopping apparatus.
Figure 19:
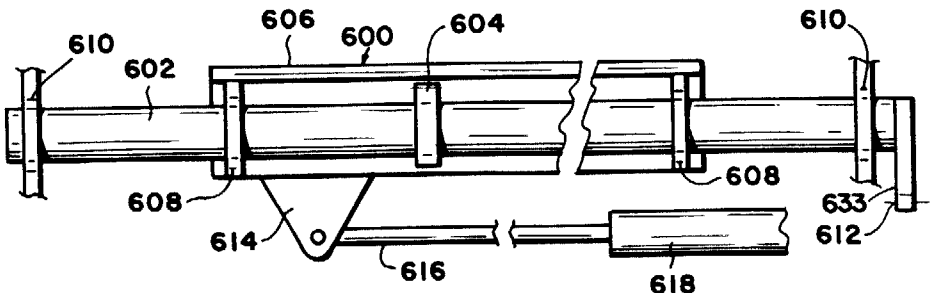
Figure 20:
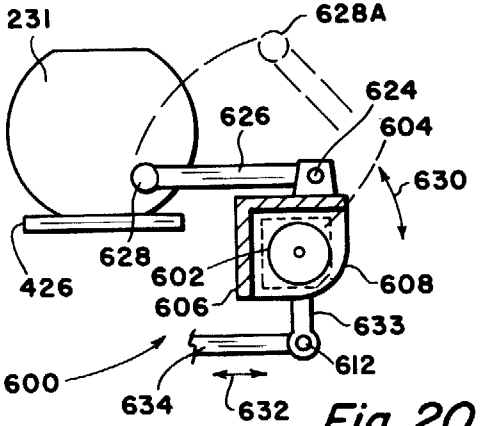

In FIGS. 18, 19, and 20, there is illustrated a second embodiment of a log stop. This one is driven by a hydraulic cylinder 618 and piston rod 616, which traverses an assembly 600 along the side of the table 434. A circular tubing 602 is supported in bearings 610 attached to the side of the table (not shown). The belt on top of the table is indicated as 426 and the log again as 231. In between the two circular tubings 602 is a square plate 604 welded to the tubing. This is shown in dashed outline in FIG. 20. The circular tubing has an arm 633 welded to the tubing, and is operated by a piston rod 634, to be rotated approximately 90°. A piece of angle iron 606 of approximately half the length of the round tubing is supported by means of plates 608, to rotate around the tubing in the position shown in FIGS. 19 and 20. By operating the piston rod 634 in a direction of arrow 632 the angle member 606 can be rotated in accordance with arrows 630. The stop arm 626, with the stop element 628 can be rotated into and out of engagement with the log as shown by the dashed position 628A.

There are two of these arm assemblies indicated generally by the numeral 620 and 622. These are rough 6 feet apart and the angle member 606 has a travel of approximately 6 feet. Thus, by having two of the stop elements 628, a stop can be positioned anywhere within 12 feet by moving the assembly only half that distance. Thus, a cylinder 618 and piston rod 616 of about 6 feet of travel will serve to set a stop at any desired point within the 12 feet. Again, as in FIG. 17, a measuring tape is desirable so that, at a certain operating point, the precise position of the stop element can be determined to any precision desired. Further details of FIG. 18 are not required inasmuch as the general mechanism is illustrated sufficiently in FIGS. 19 and 20.

After the log stop has been set and the log has been traversed to the stop, then the second end is cut off, and is grooved, if desired. The log may then be moved back to a selected position if a second saddle notch is required, etc.

There is one further cutting operation required, namely, slitting of the log longitudinally. This is required since, in the process of building two walls that intersect at right angles, the log axes in the two walls must be separated vertically by half of their vertical dimension. Thus, one log is notched out as it rests on the cross log and the next log on the cross log is notched out, etc., so as to provide a locking fit. In order to provide a log of half the height, a standardized log must be slit, the bottom half used in one wall at the floor, and the top half used in the other wall, to complete its construction to the ceiling.

Figure 23:
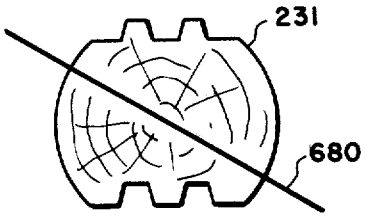

Referring now to FIGS. 21, 22, and 23, there is illustrated a slitting mechanism for the purpose of cutting a log longitudinally at a selected angle to the horizontal. The apparatus is mounted on a support plate 652 which is supported on columns, such as 202 of FIG. 2, and other figures, but is not illustrated in FIG. 21. There is another mounting plate 654, which is pivoted to the support plate 652 by a support bearing 656. Hydraulic means 660 and 662 attached to the movable plate 654 at point 664, serve to rotate the plate 654, and the saw, about the bearing 655. Thus, the blade 670 can have a horizontal position as shown or, in the extreme, a vertical position shown by the dashed line 678. The saw blade 670, as more clearly seen in FIG. 22, is supported on the outer surface of two automobile tires 668 mounted on standard wheels 666 and bearings. Adjustment means 676 are used to provide sufficient tension in the saw blade. Guide rollers 672 and 674 are provided to keep the saw blade aligned and supported close to the work piece. The opening 658 serves for the entry of the largest log, so as to contact the saw blade 670. Since the support plate 652 can be raised and lowered, the horizontal cut can be adjusted to any specific point on the log and, as shown in FIG. 23, the saw cut 680 can be made at any desired angle with regard to the log 231.

In operation the second table 434 with its driven belt on top serves to propel the log through the opening 658, past the saw.

Figure 25:
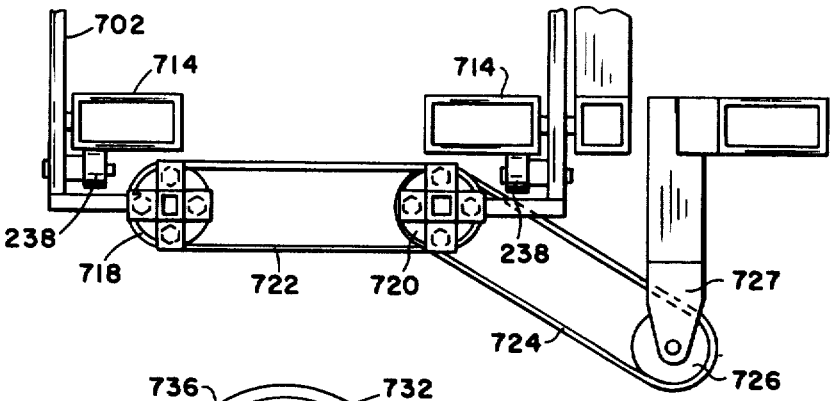
Figure 24:
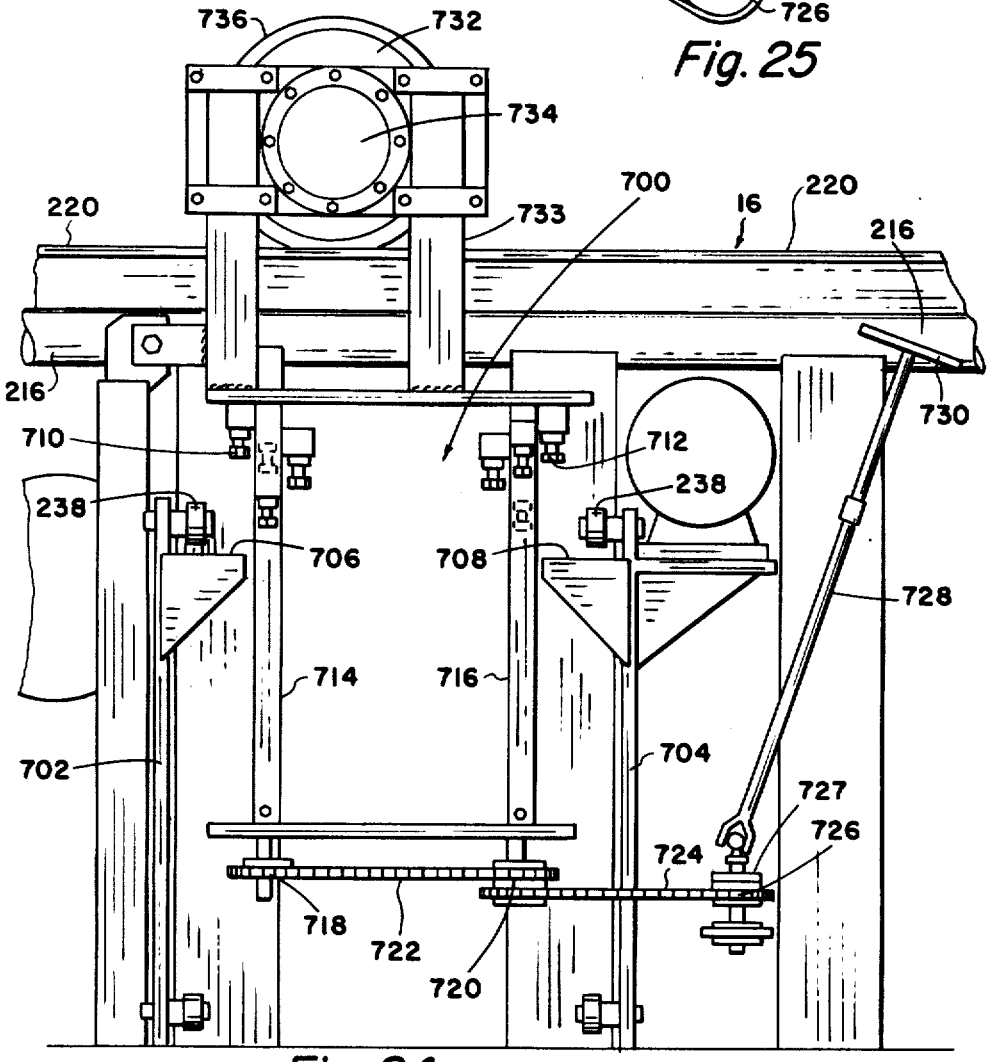

Mention was made earlier to the mechanical stops which are used in conjunction with the hydraulic cylinders to lift and position the support plates that hold the cutting mechanisms, etc. One type of stop mechanism is illustrated in FIGS. 24 and 25, where four stops 710, 712 are mounted on individual sides of tubings 714, 716, which are adapted for rotation by means, such as sprockets and chains, etc., as illustrated. The individual stops 710, 712 are welded to the tubing and include bolts and lock nuts so that the precise position of the stop surface can be adjusted.

In FIG. 24 there are two support plates 702 and 704, for example, which are guided by means of rollers 38 as previously described. The edges 706 and 708, respectively, engage the stops 710 and 712. If a different size log is to be cut, the handle 730 and shaft 728 serve to rotate the sprockets 726 and chain 724, which drives the sprockets 720 and 718, through chain 722. The two sets of stops are related to each other, and are adjusted at the same time for a specific size of log. By presetting precisely the stop position then automatically the position of the cutting machinery takes place to any desired precision of placement, by simply driving hydraulically the support plate to the stop.

Shown also in FIG. 24 is a view of the top rail 216 of the system, and a carriage indicated by numeral 16, of which the top rail 220 is shown. There is a structure 733 attached to the frame of the system, which supports a horizontal cross shaft, on which is a pair of automobile wheels 732 and 736. A hydraulic motor 734 drives this shaft at any selected speed. The tires are pressed down on the rails 220 of the carriage frame, causing it to roll to the right or to the left, depending on the direction of rotation of the drive motor.

Figure 26:
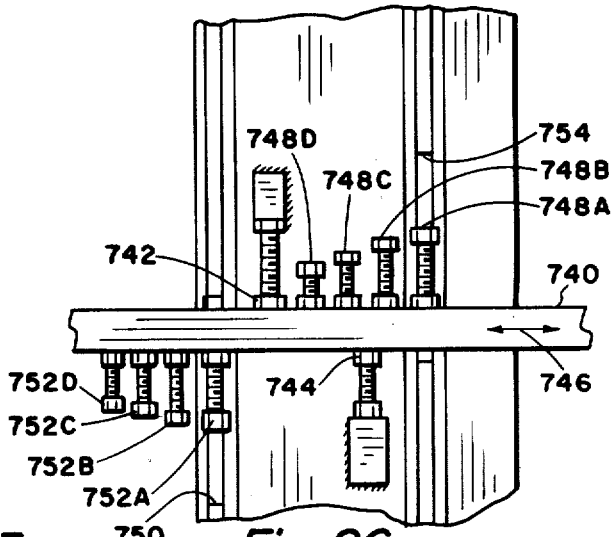
FIGS. 24, 25, and 26 illustrate one embodiment of apparatus for adjustably positioning the various cutting machines with respect to the axis of the log.

Referring now to FIG. 26, there is shown another embodiment of the stop mechanism. This comprises a horizontal rod 740, which is adapted by hydraulic controls, to be moved in accordance with arrows 746. This rod carries two sets of 4 stops, down stops, 748A, 748B, 748C, and 748D, and up stops 752A, 752B, 752C, and 752D. These can be aligned such that the contacting edge 754 is aligned with the stop 748A and the contacting edge 750 is aligned with the stop 752A. If the rod 740 is moved to the right, then a different pair of stops is brought into position, etc. The fixtures 472 and 744 are adjustable guides for the rod 740, since there will be hydraulic pressure against the stops, the stop rod 740 must be guided by the precisely set guides 742 and 744, etc.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element or step thereof is entitled.

What is claimed:

1. In a machine for manufacturing logs for log houses, including:

(a) a rectangular frame having an upstream and downstream end, a carriage adapted to travel longitudinally on top of said frame, and a rotatable center means at the ends of said carriage for axially supporting and rotating a raw log;

(b) means for positioning said raw log in said centers of said carriage, at a first level;

(c) means for moving said log and carriage longitudinally along said frame, while rotating said raw log at a selected rate of rotation relative to;

(d) a first rotating cutter means supported on said frame to cut the bark and outer layers of wood of said log to form a rough cut log of a first selected diameter and relative to;

(e) a subsequent second rotating cutter means to finish cut said log to a second smaller selected diameter;

(f) third and fourth rotating cutter means on said frame positioned respectively below and above the axis of said finish cut log by selected dimensions to shape the top and bottom surfaces of said finish cut log, means to lock said finish cut log against rotation while said finish cut log is longitudinally moved relative to said third and fourth cutter means, to form a shaped log;

(g) elongated table means and endless belt means on said table at the downstream end of said frame for supporting said shaped log, means to raise said table means and endless belt into contact with the bottom surface of said shaped log, and means to pull said center means to release said shaped log from said carriage;

(h) means to lower said shaped log on said endless belt on said table to a second level, and longitudinally moving said shaped log in a downstream direction by said belt to a multiple cutting means supported on said frame;

(i) said multiple cutting means comprising at least a cut-off saw with its plenum perpendicular to the axis of said shaped log for cutting square ends on said log at spaced positions;

the improvement in means for supporting and positioning said cutting means on said rectangular frame comprising;

(j) at least two vertical columns spaced apart on said frame in an imaginary plane that is transverse to the axis of said shaped logs;

(k) a planar support plate of selected vertical dimension supported by said columns for vertical movement transverse to the longitudinal axis of said shaped log, said cut-off saw being rotatably supported on said planar support plate; and (l) at least two eccentrically positionable rollers attached near the vertical edges of said plate, said rollers adapted to roll on said outer faces of said two columns; and (m) (1) first hydraulic cylinder means to move said planar support plate vertically along said columns.

2. The machine as in claim 1, the further improvement including means to support said plate by rollers attached to said planar support plate which roll on the two columns, the rollers adjustable inwardly or outwardly with respect to the column.

3. The machine as in claim 1, the further improvement in which said first and second rotating cutter means are supported on opposite sides of a common support plate, said common support plate supported on at least two vertical columns for vertical movement transverse to the longitudinal axis of said shaped log, said first cutter means on the upstream side of said support plate and supported below said log with the plane of said cutter passing substantially through the axis of rotation of said log, and said second rotating cutter being supported on the downstream side of said common support plate below said log, the plane of rotation of said cutter intersecting the axis of said log at a selected actue angle from between 0° and 20°.

4. The machine as in claim 1 in which said third and fourth cutting means are mounted on separate vertically movable support plates.

5. The machine as in claim 4 in which said third cutter means is supported on a support plate positioned below said finish cut log and transverse to the longitudinal dimension of said frame, and at least one stop means is provided on said frame to limit the upward travel of said plate.

6. The machine as in claim 4 in which said fourth cutter means is supported on a support plate positioned parallel to one long edge of said rectangular frame, and at least one stop means is provided on said frame to limit the downward travel of said plate.

7. The machine as in claims 5 or 6, including two hydraulic cylinders attached respectively to the support plates of said third and fourth cutter means are connected to the same hydraulic fluid line;

whereby one or the other of said plates will move into position first, and then the other, and both will be held in position against stops by the fluid pressure.

8. The machine as in claim 7 in which said locking means which prevents said log from rotating, is also connected to the same hydraulic fluid line; whereby a single valve can be used to control all three elements.

9. The machine as in claim 1, in which said multiple cutting means includes, in addition to said cut-off saw, a fifth rotating cutter means, to cut a vertical slot or groove in the end of said shaped log, each supported on said planar, said fifth cutter means separately movable upwardly from below said log, and said cut-off saw separately movable downwardly from above said log by a second hydraulic cylinder means.

10. The machine as in claim 9 in which the first and second hydraulic cylinder means are cooperatively operated by a valve such that when the valve is set to move the saw down, the valve also drives the fifth rotating cutter to its bottom position, and vice versa.

11. The machine as in claim 9 including means to actuate said first and second hydraulic cylinder means whereby, as soon as the cut-off saw starts down, the fifth cutter moves to its bottom position, and, as soon as the saw reaches its bottom position, the fifth cutter support plate can be raised, carrying the cut-off saw with it to its top positions.

12. The machine as in claim 9 in which the axis of said fifth cutter is parallel to the plane of said saw, and spaced a selected distance from said saw;

whereby, when said saw cut is completed, the fifth cutter will be in proper position to move up and cut the proper groove in the end of the log.

13. The machine as in claim 1 in which said multiple cutting means includes also a sixth rotary cutting means, comprising a saddle notch cutter.

14. The machine as in claim 13 in which said saddle notch cutter comprises:

(a) a horizontal shaft set in a longitudinally movable carriage at right angles to said rectangular frame, the vertical plane through said shaft is parallel to and spaced a selected distance from said cut-off saw;

(b) said shaft carries a series of rotary cutters of different selected diameters, corresponding to the selected sizes of logs;

(c) means to move the sixth cutter assembly completely to one side of the log, with the smallest diameter cutter closest to the log, and the larger diameter cutters spaced farther away;

(d) suitable stop means to limit the inward movement of said shaft and cutters, so that only the selected first, second, third, etc., of the cutters can pass through the log;

(e) the axis of the cutters is in a horizontal plane tangent to the bottom surface of the circular log;

whereby, when the selected cutter is of the same diameter as the log, the saddle cut will reach to the axis of the log.

15. The machine as in claim 1 including a second elongated table means including belt means, for supporting said shaped log on said belt, and a hydraulically adjustable stop means on said frame for precisely positioning said shaped log with respect to said multiple cutting means.

16. The machine as in claim 15 in which said stop means comprises;

(a) elongated guide means supported at its ends in a horizontal position spaced laterally from said second table means;

(b) means for rotating said guide means about its axis through a selected angle;

(c) elongated bar means attached to slidable means to be longitudinally traversed along said guide means;

(d) at least one transverse arm hinged by a longitudinal axis to said bar means, with an adjustable stop attached to said arm, whereby, when said guide is rotated in one direction over said second table, it is in position to intercept the leading end of a log moving along said table; and when said guide is rotated in the other direction said arm is lifted out of the way of a log moving along said table; and (e) means to position said bar and arm at a selected position along said guide;

whereby the leading end of said log can be positioned at a selected distance from said cross-cut saw to cut said log to a selected length.

17. The machine as in claim 16 including a plurality of arms and stops spaced at selected positions along said bar means;

whereby a log of length greater than the position of the first stop can be positioned by moving said strip and arms a distance less than the spacing between the arms.

18. The machine as in claim 1 including log slitting means positioned downstream of said multiple cutting means, said slitting means adapted to longitudinally slit said log along a plane parallel to the axis of said log, and with said plane adjustable through a 90° angle from horizontal to vertical.

19. The machine as in claim 18, in which said log slitting means comprises;

(a) a vertically movable support plate with its plane transverse to said rectangular frame;

(b) a horizontal shaft attached to one face of said support plate at a selected position;

(c) a band saw on a vertical saw plate comprising;

(1) a pair of wheels rotatably attached to stub horizontal shafts attached to said saw plate;

(2) said wheels carrying a rubber surface, and supporting a steel saw loop of selected length;

(3) means to guide said blade;

(d) means to rotatably support said saw plate on said horizontal shaft; and (e) openings through said vertical support plate and saw plate;

whereby a shaped log cut to length on said second table can be traversed into and through said openings and be intercepted by said saw, said saw having previously been set to the selected angle for slitting.

20. The machine as in claim 1 in which said means for positioning a raw log in said centers comprise;

(a) two spaced apart vertical support plates guided for vertical motion in planes transverse to the axis of said rectangular frame;

(b) the top of said support plates having a V contour, whereby a cylindrical log resting in said V contours would be supported horizontally with its axis in a vertical plane through the rotating centers of said carriage;

(c) a horizontal hinged arm supported at its center by a longitudinal shaft, at a selected position above the top of, and along one edge of, said frame, approximately in each of the planes of said two support plates;

(d) the ends of said arms overhanging said frame attached by hinged adjustable rod means to the corresponding edges of said support plates;

whereby, as said support plates move upwardly, the outer ends of said arms move upwardly, the inner ends of said arms move downwardly, and press on a log held in said V contours to accurately center said log with the axis of said carriage; and (e) means to press said centers of said carriage into said log, to support said log for rotation.

21. The machine as in claim 20 including hydraulic cylinder means to rotate said saw plate with respect to said vertical support plate through a selected angle.

22. The machine as in claim 1, including;

(a) longitudinal horizontal plates mounted on the top edges of said carriage;

(b) a horizontal shaft transverse to the axis of said carriage, above said carriage, supported in bearings attached to vertical extensions of said frame;

(c) two rubber-tired wheels supported on said shaft, one in alignment with each of said horizontal plates of said carriage; and (d) means to rotate said shafts with said wheels pressing on said plate, whereby said carriage is traversed.

* * * * *